US009128426B2

(12) United States Patent
Fujimoto et al.

(10) Patent No.: US 9,128,426 B2
(45) **Date of Patent: *Sep. 8, 2015**

(54) FIXING DEVICE AND IMAGE FORMING APPARATUS INCLUDING SAME

(71) Applicant: RICOH COMPANY, LTD., Ohta-ku (JP)

(72) Inventors: Ippei Fujimoto, Ebina (JP); Akira Shinshi, Machida (JP); Naoki Iwaya, Chofu (JP); Yoshiki Yamaguchi, Sagamihara (JP); Shuntaroh Tamaki, Kawasaki (JP); Hiroshi Yoshinaga, Ichikawa (JP); Yutaka Ikebuchi, Chigasaki (JP); Toshihiko Shimokawa, Zama (JP); Kenichi Hasegawa, Atsugi (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/899,197

(22) Filed: May 21, 2013

(65) Prior Publication Data

US 2013/0251430 A1 Sep. 26, 2013

Related U.S. Application Data

(63) Continuation of application No. 12/879,875, filed on Sep. 10, 2010, now Pat. No. 8,463,168.

(30) Foreign Application Priority Data

Sep. 10, 2009 (JP) ..... 2009-208826

(51) Int. Cl.
*G03G 15/20* (2006.01)

(52) U.S. Cl.
CPC ..... *G03G 15/2007* (2013.01); *G03G 15/2039* (2013.01)

(58) Field of Classification Search
CPC ..... G03G 15/2007; G03G 15/2039
USPC ..... 399/320, 328, 335, 336
See application file for complete search history.

(56) References Cited

U.S. PATENT DOCUMENTS 6,131,009 A * 10/2000 Hasegawa ..... 399/328
6,496,666 B2 * 12/2002 Hayashi et al. ..... 399/69

(Continued)

FOREIGN PATENT DOCUMENTS

JP 63-92367 U 6/1988
JP 2004-029611 1/2004

(Continued)

OTHER PUBLICATIONS

Japanese Office Action dated Nov. 28, 2013 for Japanese Patent Application No. 2009-208826.

(Continued)

*Primary Examiner* — Ryan Walsh
(74) *Attorney, Agent, or Firm* — Oblon, McClelland, Maier & Neustadt, L.L.P.

(57) ABSTRACT

A fixing device to fix a toner image on a sheet includes a first rotary member that rotates in a predetermined direction and a second rotary member that contacts an outer circumferential surface of the first rotary member. A stationary member is fixed inside the first rotary member to press the first and second rotary members together to form a nip portion between the rotary members. A reinforcement member is fixedly provided inside the first rotary member and pressed against the stationary member. The fixing device includes heat source to heat the first rotary member and a reflector to reflect heater light emitted from the heat source toward the first rotary member.

18 Claims, 7 Drawing Sheets

(56) References Cited

U.S. PATENT DOCUMENTS

| | | | | |
|---|---|---|---|---|
| 6,591,081 | B2 * | 7/2003 | Hasegawa | 399/324 |
| 6,628,916 | B2 * | 9/2003 | Yasui et al. | 399/329 |
| 6,636,709 | B2 * | 10/2003 | Furukawa et al. | 399/69 |
| 6,778,790 | B2 * | 8/2004 | Yoshinaga et al. | 399/69 |
| 6,778,804 | B2 * | 8/2004 | Yoshinaga et al. | 399/325 |
| 6,785,505 | B2 * | 8/2004 | Yasui et al. | 399/329 |
| 6,881,927 | B2 * | 4/2005 | Yoshinaga et al. | 219/216 |
| 6,882,820 | B2 * | 4/2005 | Shinshi et al. | 399/328 |
| 6,892,044 | B2 * | 5/2005 | Yasui et al. | 399/324 |
| 7,022,944 | B2 * | 4/2006 | Yoshinaga et al. | 219/216 |
| 7,070,182 | B2 * | 7/2006 | Hasegawa | 271/307 |
| 7,127,204 | B2 * | 10/2006 | Satoh et al. | 399/329 |
| 7,151,907 | B2 * | 12/2006 | Yoshinaga | 399/333 |
| 7,239,838 | B2 * | 7/2007 | Sato et al. | 399/329 |
| 7,242,897 | B2 * | 7/2007 | Satoh et al. | 399/329 |
| 7,313,353 | B2 * | 12/2007 | Satoh et al. | 399/329 |
| 7,330,682 | B2 * | 2/2008 | Shinshi | 399/122 |
| 7,379,698 | B2 * | 5/2008 | Yoshinaga | 399/329 |
| 7,437,111 | B2 * | 10/2008 | Yamada et al. | 399/327 |
| 7,454,151 | B2 * | 11/2008 | Satoh et al. | 399/69 |
| 7,466,949 | B2 * | 12/2008 | Satoh et al. | 399/323 |
| 7,509,085 | B2 * | 3/2009 | Yoshinaga et al. | 399/325 |
| 7,515,850 | B2 * | 4/2009 | Hasegawa | 399/124 |
| 7,546,049 | B2 * | 6/2009 | Ehara et al. | 399/69 |
| 7,593,680 | B2 * | 9/2009 | Shinshi | 399/329 |
| 7,630,652 | B2 * | 12/2009 | Hasegawa | 399/13 |
| 7,702,271 | B2 * | 4/2010 | Yamada et al. | 399/327 |
| 7,742,714 | B2 * | 6/2010 | Shinshi et al. | 399/68 |
| 8,150,305 | B2 | 4/2012 | Shin | |
| 2006/0029411 | A1 * | 2/2006 | Ishii et al. | 399/67 |
| 2006/0257183 | A1 * | 11/2006 | Ehara et al. | 399/405 |
| 2007/0003334 | A1 * | 1/2007 | Shinshi et al. | 399/327 |
| 2007/0014600 | A1 * | 1/2007 | Ishii et al. | 399/328 |
| 2007/0059071 | A1 * | 3/2007 | Shinshi et al. | 399/400 |
| 2007/0292175 | A1 * | 12/2007 | Shinshi | 399/329 |
| 2008/0063443 | A1 * | 3/2008 | Yoshinaga et al. | 399/328 |
| 2008/0112739 | A1 * | 5/2008 | Shinshi | 399/329 |
| 2008/0175633 | A1 * | 7/2008 | Shinshi | 399/329 |
| 2008/0219730 | A1 * | 9/2008 | Shinshi | 399/333 |
| 2008/0253788 | A1 * | 10/2008 | Shinshi | 399/69 |
| 2008/0253789 | A1 * | 10/2008 | Yoshinaga et al. | 399/69 |
| 2008/0298862 | A1 * | 12/2008 | Shinshi | 399/324 |
| 2008/0317532 | A1 * | 12/2008 | Ehara et al. | 399/400 |
| 2009/0003867 | A1 * | 1/2009 | Fujimoto | 399/69 |
| 2009/0067902 | A1 * | 3/2009 | Yoshinaga et al. | 399/329 |
| 2009/0123201 | A1 * | 5/2009 | Ehara et al. | 399/328 |
| 2009/0123202 | A1 * | 5/2009 | Yoshinaga et al. | 399/329 |
| 2009/0148204 | A1 * | 6/2009 | Yoshinaga et al. | 399/328 |
| 2009/0169232 | A1 * | 7/2009 | Kunii et al. | 399/70 |
| 2009/0245865 | A1 * | 10/2009 | Shinshi et al. | 399/122 |
| 2009/0311016 | A1 * | 12/2009 | Shinshi | 399/329 |
| 2010/0074667 | A1 * | 3/2010 | Ehara et al. | 399/395 |
| 2010/0092220 | A1 * | 4/2010 | Hasegawa et al. | 399/328 |
| 2010/0092221 | A1 * | 4/2010 | Shinshi et al. | 399/330 |
| 2010/0202809 | A1 * | 8/2010 | Shinshi et al. | 399/329 |
| 2010/0232822 | A1 | 9/2010 | Takenaka et al. | |
| 2011/0274453 | A1 | 11/2011 | Shimokawa et al. | |

FOREIGN PATENT DOCUMENTS

| | | |
|---|---|---|
| JP | 2004-252206 | 9/2004 |
| JP | 2004-258484 | 9/2004 |
| JP | 2006-267901 A | 10/2006 |
| JP | 2007-310244 | 11/2007 |
| JP | 2008-009015 | 1/2008 |
| JP | 2008139382 | 6/2008 |
| JP | 2008-158482 | 7/2008 |
| JP | 2008-224878 | 9/2008 |
| JP | 2009-3410 | 1/2009 |

OTHER PUBLICATIONS

English translation of Japanese Publication No. 2004-258484 dated Sep. 16, 2004.

Japanese Office Action issued May 23, 2013, in Japan Patent Application No. 2009-208826.

* cited by examiner

FIXING DEVICE AND IMAGE FORMING APPARATUS INCLUDING SAME

CROSS-REFERENCE TO RELATED APPLICATIONS

This patent application is a continuation of U.S. application Ser. No. 12/879,875 filed Sep. 10, 2010, which claims priority from Japanese Patent Application No. 2009-208826, filed on Sep. 10, 2009 in the Japan Patent Office, the entire content of each of which are hereby incorporated by reference in their entirety.

BACKGROUND OF THE INVENTION

1. Field of the Invention

The present invention generally relates to a fixing device used in an image forming apparatus such as a copier, a printer, a facsimile machine, or a multifunction machine including at least two of these functions, and an image forming apparatus including the fixing device.

2. Discussion of the Background

In general, electrophotographic image forming apparatuses, such as copiers, printers, facsimile machines, and multifunction machines including at least two of these functions, include an image carrier on which an electrostatic latent image is formed, a developing unit to develop the latent image with toner, a transfer member, and a fixing device. The developed image (toner image) is transferred from the image carrier onto a sheet of recording media by the transfer member and then fixed on the sheet with heat and pressure by the fixing device.

Fixing devices may include an endless belt, a pressure roller that contacts an outer circumferential surface of the belt and pressures the belt, a stationary member fixed inside the belt to press against the rotary member via the belt, and a heater for heating the belt. The endless belt and the pressure roller contact each other, and a nip area is formed in the contact area.

When the fixing device heats and pressurizes the toner image on a recording medium by the nip area, the toner image is fixed on a recording medium.

Market demand for high-speed image forming apparatuses makes it desirable that a toner image be fixed on a recording medium properly in the fixing device even when the image forming apparatus forms the toner image on the recording medium at high speed with a shortened warm-up time period.

SUMMARY OF THE INVENTION

In view of the foregoing, one illustrative embodiment of the present invention provides a fixing device to fix a toner image on a sheet of recording media. The fixing device includes a first rotary member that rotates in a predetermined direction, a second rotary member that contacts an outer circumferential surface of the first rotary member, and a fixed (stationary) member positioned inside the belt, at a stationary location, to press the first and second rotary members together, forming a nip portion therebetween through which the sheet is transported. In this embodiment, a reinforcement member may strengthen or support the stationary member. A heat source is typically included in the fixing device to heat the first rotary member, and a reflector is included to reflect the heat or the light of the heat source.

In one embodiment, the reflector comprises aluminum. In one embodiment, a space between the reinforcement member and the reflector is an air layer. One embodiment of the invention provides thermal insulation disposed between the reinforcement member and the reflector. In one preferred embodiment, the reflector includes a curved surface. In one preferred embodiment, the curved surface is curved in a same direction as an inner circumferential surface of the first rotary member.

In one embodiment, the reflector includes a hole to attach the reflector to the reinforcement member with a screw. The hole is typically offset from the first rotary member in an axial direction of the first rotary member so as not to overlap the first rotary member as viewed in a direction perpendicular to the axial direction.

In another illustrative embodiment of the present invention, an image forming apparatus includes an image carrier on which an electrostatic latent image may be formed, a developing unit to develop the latent image on the image carrier into a toner image, a transfer unit to transfer the toner image onto a recording medium, and the fixing device described above.

Another example of the invention includes a method of assembling a fixing device that fixes a toner image on a sheet of recording media. The method includes providing a first rotary member that rotates in a predetermined direction and placing a second rotary member in contact with an outer circumferential surface of the first rotary member. The method further includes installing a stationary member inside the first rotary member and pressing the first rotary member against the second rotary member with the stationary member to form a nip portion between the first and second rotary members through which the sheet is transported. The stationary member is typically disposed at a location stationary relative to the nip portion.

The method further includes installing, at a location inside the first rotary member stationary relative to the nip portion, a reinforcement member, and exerting force against the stationary member with the reinforcement member. Thus, the reinforcement member typically assists in supporting the stationary member. The method further includes installing a reflector within the first rotary member and coupling the reflector to a location inside the first rotary member via at least one fastener disposed in at least one hole in the reflector. The at least one hole is preferably offset from the first rotary member in an axial direction of the first rotary member so as not to overlap the first rotary member as viewed in a direction perpendicular to the axial direction. Additionally, the method includes inserting a heater within the first rotary member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
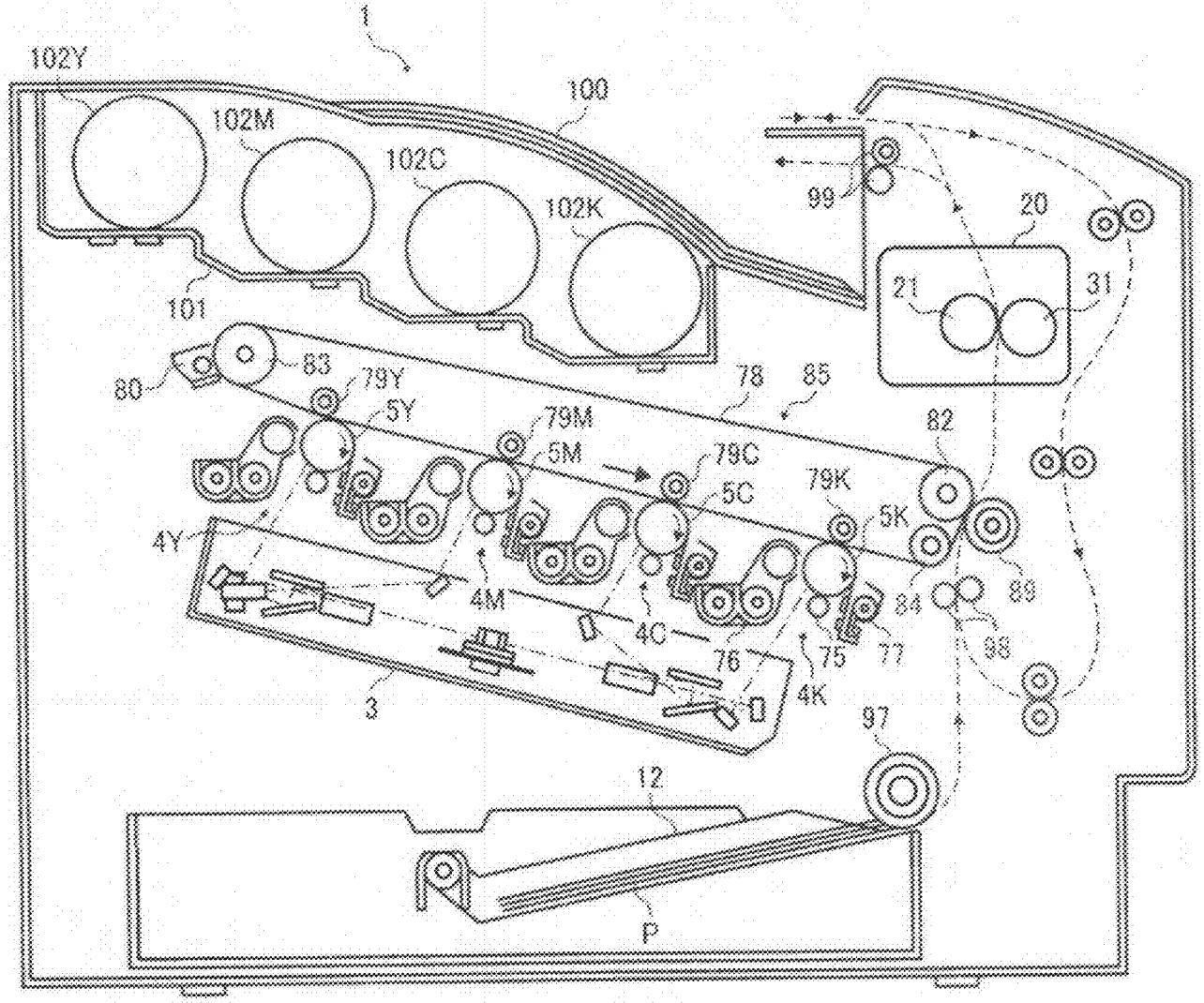
FIG. 1 illustrates a schematic configuration of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described. It is to be noted that, in the description below, reference characters Y, M, C, and K represent yellow, magenta, cyan, and black, respectively, and may be omitted when color discrimination is not required.

FIG. 1 illustrates an example of an image forming apparatus 1 that in the present embodiment is a tandem multicolor printer. As shown in FIG. 1, the image forming apparatus 1 includes a bottle container 101 disposed in an upper portion thereof, an intermediate transfer unit 85 that is disposed beneath the bottle container 101 and includes an intermediate transfer belt 78, an exposure unit 3 disposed beneath the intermediate transfer unit 85, and a sheet feeder 12 disposed in a bottom portion thereof.

The bottle container 101 includes toner bottles 102Y, 102M, 102C, and 102K that respectively contain yellow, magenta, cyan, and black toners and are detachably attached to the bottle container 101.

Further, image forming units 4Y, 4M, 4C, and 4K are provided to face a lower portion of the intermediate transfer belt 78. Each image forming unit 4 includes a drum-shaped photoreceptor 5 (depicted as 5Y, 5M, 5C, or 5K according to color) serving as an image carrier, and a charger 75, a developing unit 76, a cleaning unit 77, and a discharger, not shown, are provided around the photoreceptor 5. In each image forming unit 4, a sequence of image forming processes including a charge process, an exposure process, a development process, and a cleaning process is performed on a surface of the photoreceptor 5 to from a single-color image.

The depicted photoreceptor 5 is rotated clockwise in FIG. 1 by a driving motor, not shown. The surface of the photoreceptor 5 is charged uniformly at the position of the charger 75 (charge process) and then reaches a portion to receive a laser light L emitted from the exposure unit 3, where the surface of the photoreceptor 5 is scanned with the laser light L, thereby forming an electrostatic latent image corresponding to the single-color image thereon (exposure process).

Subsequently, the surface of the photoreceptor 5 reaches a portion facing the developing unit 76, where the latent image is developed with toner into a single-color toner image (development process) and then reaches a portion facing a primary transfer bias roller 79 via the intermediate transfer belt 78, where the toner image is transferred from the photoreceptor 5 onto the intermediate transfer belt 78 (primary transfer process). After this process, a small amount of toner (non-transferred toner) can remain non-transferred on the photoreceptor 5.

The surface of the photoreceptor 5 further moves to a portion facing the cleaning unit 77, where a cleaning blade of the cleaning unit 77 removes the toner remaining on the photoreceptor 5 mechanically (cleaning process), after which the discharger, not shown, removes electrical potential remaining on the photoreceptor 5. Thus, a sequence of image forming processes is completed.

The depicted intermediate transfer unit 85 includes the four primary transfer bias rollers 79, a belt cleaner 80, back-up rollers 82 and 83, a tension roller 84, and the intermediate transfer belt 78 wound around the back-up rollers 82 and 83 and the tension roller 84. The intermediate transfer belt 78 rotates in a direction indicated by an arrow shown in FIG. 1 as the back-up roller 82 rotates. The back-up rollers 82 and 83 respectively press against a secondary transfer roller 89 and the belt cleaner 80 via the intermediate transfer belt 78. The intermediate transfer unit 85 and the secondary transfer roller 89 together form a transfer unit to transfer the toner image from the photoreceptors 5 onto a sheet of recording media.

Each of the four primary transfer bias rollers 79 and the corresponding photoreceptor 5 sandwich the intermediate transfer belt 78, forming a primary transfer nip therebetween. Each primary transfer bias roller 79 receives a transfer bias whose polarity is opposite that of the toner.

In the primary transfer process, while the intermediate transfer belt 78 rotates in the direction indicated by the arrow shown in FIG. 1, passing through the primary transfer nips, the single-color images are electrostatically transferred from the respective photoreceptors 5 sequentially by the primary transfer bias rollers 79 and are then superimposed one on another on the intermediate transfer belt 78. Thus, a multicolor image is formed thereon.

Subsequently, as the intermediate transfer belt 78 further rotates, the multicolor image reaches a position facing the secondary transfer roller 89, where the back-up roller 82 and the secondary transfer roller 89 sandwich the intermediate transfer belt 78 therebetween, forming a secondary transfer nip. Then, in a secondary transfer process, the multicolor image is transferred from the intermediate transfer belt 78 onto a sheet P of recording media in the secondary transfer nip.

Subsequently, the belt cleaner 80 removes any toner remaining on the intermediate transfer belt 78 because a small amount of toner can remain thereon after the secondary transfer process. Thus, a sequence of processes performed on the intermediate transfer belt 78 is completed.

The sheet feeder 12 typically contains multiple sheets P stacked one on another and is provided with a feed roller 97. When the feed roller 97 rotates counterclockwise in FIG. 1, the sheets P are fed, from the top, one by one toward a pair of registration rollers 98. The registration rollers 98 stop rotating when sandwiching the sheet P therebetween and then start rotating to forward the sheet P to the secondary transfer nip, timed to coincide with the multicolor image on the intermediate transfer belt 78.

After the multicolor image is transferred thereonto in the secondary transfer nip, the sheet P is transported to a fixing device 20 that includes a fixing belt 21 and a pressure roller 31. The fixing device 20 fixes the image on the sheet P with heat and pressure (fixing process), after which a pair of discharge rollers 99 discharges the sheet P onto a stack part 100 provided on an upper surface of the image forming apparatus 1.

The fixing device 20 is described in further detail below with reference to FIGS. 2 through 4.

Figure 2:
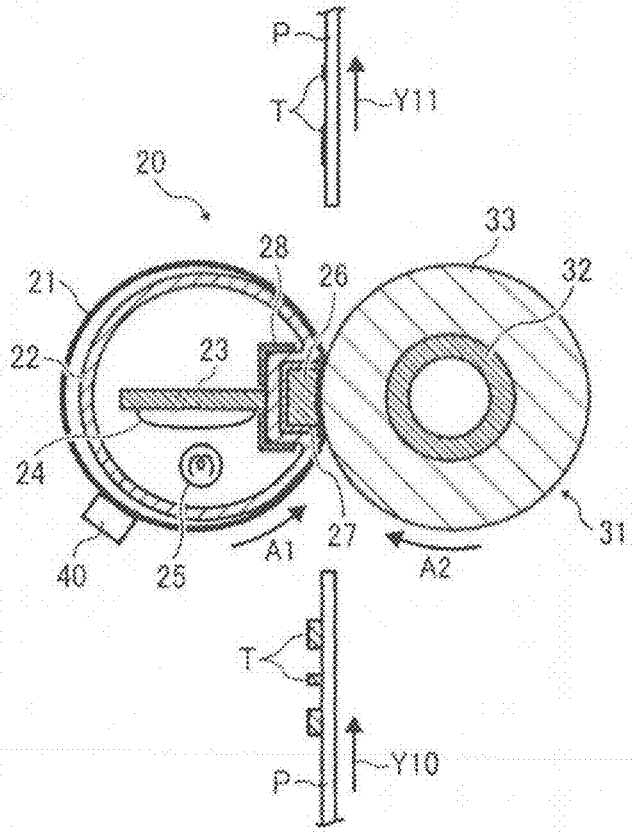
FIG. 2 illustrates a fixing device included in the image forming apparatus shown in FIG. 1.
Figure 3:
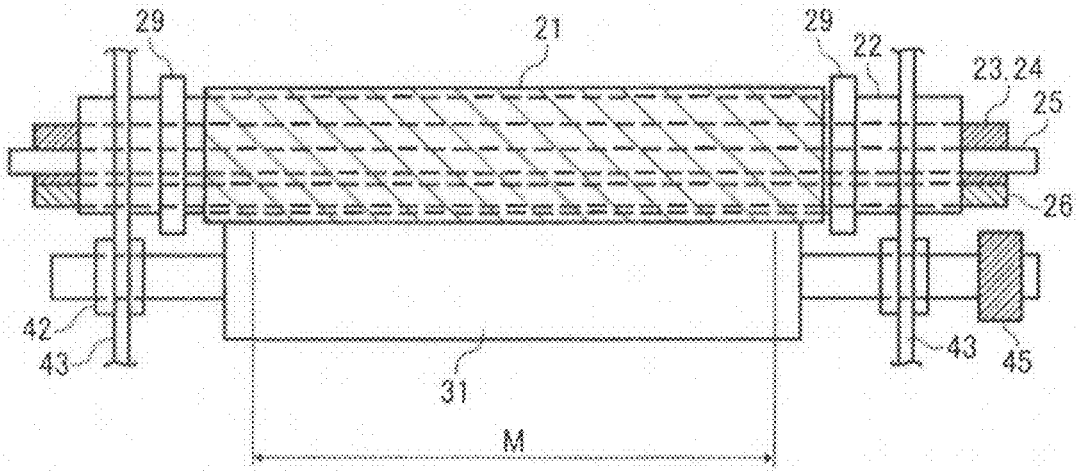
FIG. 3 illustrates the fixing device shown in FIG. 2 in a width direction (in a direction perpendicular to an axial direction thereof)
Figure 4:
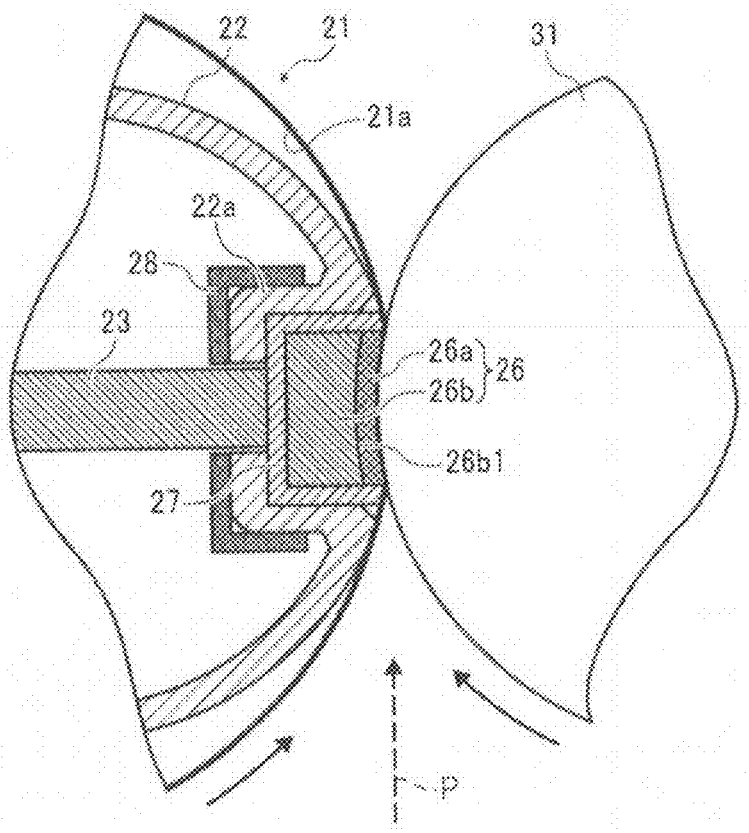
FIG. 4 is an enlarged view of a portion around a fixing nip formed between a fixing belt and a pressure roller of the fixing device shown in FIG. 2.

FIG. 2 is an end-on (axial) cross-sectional view illustrating the fixing device 20, FIG. 3 illustrates the fixing device in a width direction or a direction perpendicular to an axial direction thereof, and FIG. 4 is an enlarged view of a portion around a fixing nip formed between the fixing belt 21 and the pressure roller 31 (hereinafter "nip portion").

As shown in FIG. 2, in the present embodiment, the fixing device 20 includes the fixing belt 21 serving as a first rotary member, a heating member 22, a reinforcement member 23, a reflector 24, a heater 25 serving as a heating member or heat source, a fixed (pressing) member 26, a thermal insulator 27, a holder 28, the pressure roller 31 serving as a second rotary member, and a temperature sensor 40.

The fixing belt 21 is a flexible thin endless belt and typically rotates counterclockwise, that is, in a direction indicated by arrow A1 shown in FIG. 2. For example, the fixing belt 21 has a thickness of 1 mm or thinner and includes a base layer, an elastic layer, and a release layer from the side of an inner surface layer (inner circumferential surface) 21*a*.

The respective layers of the fixing belt 21 in the present embodiment are described below.

The base layer has a layer thickness of within a range from 30 μm to 50 μm. Examples of a material of the base layer include, but are not limited to, metal such as nickel and stainless steel; and resin such as polyimide.

The elastic layer typically has a layer thickness of within a range from 100 μm to 300 μm and can be formed with rubber, for one example. Examples of a material of the elastic layer include, but not limited to, silicone rubber, foamed silicone rubber, and fluorine-containing rubber. Providing the elastic layer in the fixing belt 21 can prevent or reduce minute asperities created on an outer surface of the fixing belt 21 in the fixing nip, and thus heat can be relatively uniformly transmitted to a toner image T on the sheet P. If heat is unevenly transmitted to the toner image, a fixed image may be a so-called orange-peel image, which means an image whose surface is irregular or grainy like the surface of oranges. Thus, providing the elastic layer in the fixing belt 21 can prevent or reduce orange-peel images.

The release layer typically has a thickness within a range from 10 μM to 50 μm. Examples of a material of the release layer include, but are not limited to, tetrafluoroethylene-perfluoro(alkyl vinyl ether) copolymer (PFA), polytetrafluoroethylene (PTFE), polyimide, polyether imide, polyether sulfide (PES). Providing the release layer can give the fixing belt 21 toner releasability.

The endless fixing belt 21 can have a diameter of within a range from 15 mm to 120 mm, and the diameter is 30 mm in the present embodiment. The heating member 22, the reinforcement member 23, the reflector 24, the heater 25, the fixed (stationary) member 26, the thermal insulator 27, and the holder 28 are fixed inside the fixing belt 21. As shown in FIG. 3, both end portions in the width direction of each of the heating member 22, the heater 25, and the fixed member 26 are respectively fixed to side plates 43 of the fixing device 20 and held thereby.

The components fixed inside the fixing belt 21 are described in further detail below with reference to FIGS. 3 and 4.

The fixed member 26 is fixed inside the fixing belt 21 so as to slidingly contact the inner circumferential surface (sliding surface) 21*a* of the fixing belt 21 via lubricant such as fluorine-containing grease. The pressure roller 31 presses against the fixed member 26 via the fixing belt 21 so as to form the fixing nip between the fixing belt 21 and the pressure roller 31.

The heating member 22 is typically shaped like a pipe and faces the inner circumferential surface 21*a* of the fixing belt 21 except the nip portion. At the nip portion, the heating member 22 holds the fixed member 26 via the thermal insulator 27. Flanges 29 are attached at the both ends of the heating member 22 to limit movement of the fixing belt 21 in the width direction of the heating member 22.

The heating member 22 heats the fixing belt 21, being heated by radiation heat from the heater 25. In other words, the heater 25 heats the heating member 22 directly, and then the fixing member 21 is indirectly heated via the heating member 22. It is to be noted that the thickness of the heating member 22 is equal to or less than 0.1 mm to maintain the heating efficiency of the fixing belt 21 well.

Examples of a material of the heating member 22 include, but are not limited to, thermal conductive metal such as aluminum, nickel, iron, and stainless steel. Ferritic stainless steel is suitable for the material of the heating member 22, because the thermal capacity of the ferritic stainless steel per the unit volume is comparatively small. In this embodiment, material of the heating member 22 is SUS430 which is ferritic stainless steel. In addition, the thickness of heating member 22 is 0.1 mm, in this example.

The heater 25 may be a halogen heater, carbon heater, or the like. The heater 25 heats the heating member 22 with radiation heat whose output is controlled by a power source unit, not shown, of the image forming apparatus 1. Then, the heating member 22 heats the fixing belt 21 entirely except the nip portion, and then the heat is transmitted from the surface of the fixing member 21 to the toner image T on the sheet P. Herein, the output from the heater 25 is controlled based on a surface temperature of the fixing belt 21 detected by the temperature sensor 40, which can be a thermistor disposed to face the circumferential surface of the fixing belt 21. A temperature (fixing temperature) of the fixing belt 21 can be set to a given temperature by controlling the output from the heater 25.

As described above, in the fixing device 20 according to the present embodiment, the heating member 22 can heat the fixing belt 21 across substantially its entire circumference. Therefore, the fixing belt 21 can be sufficiently heated even when the process speed of the fixing device 20 is increased, thus preventing or reducing fixing failures. Thus, because the fixing belt 21 can be heated efficiently using a relatively simple configuration, warm-up time and a first print time can be shorter, and the fixing device 20 can be more compact.

It is to be noted that a gap δ between the inner circumferential surface 21*a* of the fixing belt 21 and the heating member 22 disposed therein is greater than 0 mm and is not greater than 1 mm (0 mm<δ≤1 mm) except the nip portion. This configuration can increase an area where the heating member 22 slidingly contacts the fixing belt 21, and accordingly wear of the fixing belt 21 can be reduced while maintaining sufficient fixing efficiency, which may be unavailable when the fixing belt 21 is relatively far away from the heating member 22. Additionally, disposing the heating member 22 closely inside the fixing belt 21 can keep the flexible fixing belt 21 circular to a certain extent, which can reduce deterioration of and/or damage to the fixing device 20 caused by deformation of the fixing belt 21.

Wear of the fixing belt 21 caused by the sliding contact between the fixing belt 21 and the heating member 22 can be further reduced because lubricant such as fluorine-containing grease is typically provided between the fixing belt 21 and the heating member 22. Additionally, an outer circumferential surface (hereinafter also "sliding surface") of the heating member 22 that slidingly contacts the inner circumferential surface of the fixing belt 21 can be formed with a material whose frictional coefficient is relatively low.

It is to be noted that, although the depicted heating member 22 has a substantially circular cross-section in the present embodiment, the heating member 22 can have a polygonal cross-section, or slits may be provided on the circumferential surface of the heating member 22.

In the present embodiment, the reinforcement member 23 is fixed inside the inner circumferential surface of the fixing belt 21 to strengthen the fixed member 26 for forming the fixing nip. Referring to FIG. 3, a length in the width direction of the reinforcement member 23 is identical or similar to that of the fixed member 26, and both end portions of the reinforcement member 23 are respectively fixed to the side plates 43 of the fixing device 20 and held thereby. As the reinforcement member 23 contacts the pressure roller 31 via the fixing belt 21 as well as the fixed member 26, the fixed member 26 can be prevented from deforming significantly at the nip portion being pressed by the pressure roller 31

It is preferable that the reinforcement member 23 be formed with metal, such as stainless steel or iron, whose mechanical strength is relatively high to attain the above-described function.

The reinforcement member 23 is arranged to almost divide the inside of the heating member 22 into two spaces. The reinforcement member 23 typically has the form of an elongated beam.

The reflector 24 is fixed to the reinforcement member 23. Referring to FIG. 3, a length in the width direction of the reflector 24 is identical or similar to that of the reinforcement member 23. The reflector 24 reflects heater light emitted by the heater 25 for the inner surface of the heating member 22. The depicted reflector 24 is convex to match the curved surface shape of the inner surface of the heating member 22. In other words a curve course of the reflector 24 is a course the same as the curve direction of the internal perimeter surface of the heating member 22. With such a configuration, the heat or the heater light from the heater 25 toward the reinforcement member 23 spreads and reflects via the reflector 24 and then can be used to heat the heating member 22, thus further enhancing the heating efficiency of the fixing belt 21 or the heating member 22.

The pressure roller 31 is described in further detail below with reference to FIG. 2.

The pressure roller 31 serves as the second rotary member that presses against the outer circumferential surface of the fixing belt 21 so as to attain a nip of desired width therebetween. The depicted pressure roller 31 has a diameter of 30 mm, for example, and includes a metal core 32 and an elastic layer 33 covering the metal core 32. The elastic layer 33 can be formed with silicone rubber, foamed silicone rubber, fluorine-containing rubber, or the like. Further, a thin release layer formed with PFA, PTFE, or the like can be provided on an outer surface of the elastic layer 33. Referring to FIG. 3, a gear 45 that engages a driving gear of a driving unit, not shown, is attached to the pressure roller 31, and the pressure roller 31 is rotated clockwise, that is, in a direction indicated by arrow A2 shown in FIG. 2. Both end portions of the pressure roller 31 in the width direction are rotatably held by the side plates 43 of the fixing device 20 via bearings 42, respectively. Additionally, a heat source such as a halogen heater can be provided inside the pressure roller 31.

When the elastic layer 33 is formed with a spongy material such as foamed silicone rubber, a pressure to the nip portion can be lower, thus reducing deformation of the heating member 22. Simultaneously, the heat from the fixing belt 21 is less likely to be transmitted to the pressure roller 31 because thermal insulation of the pressure roller 31 can be enhanced, thereby enhancing the heating efficiency of the fixing belt 21.

It is to be noted that, although the diameter of the fixing belt 21 is typically similar to that of the pressure roller 31 in the present embodiment, alternatively, the diameter of the fixing belt 21 can be smaller than that of the pressure roller 31. This configuration facilitates separation of the sheet P from the fixing belt 21 at an exit of the fixing nip because a curvature of the fixing belt 21 at the nip portion is larger than that of the pressure roller 31.

Referring to FIG. 4, the fixed member 26 that slidingly contacts the inner surface layer 21*a* of the fixing member 21 includes a base layer 26*b* and an surface layer 26*a* covering the base layer 26*b*. A surface (hereinafter also "sliding surface") of the fixed member 26 facing the pressure roller 31 includes concavity along the curvature of the pressure roller 31, which allows the sheet P to leave the fixing belt 21 along the curvature of the pressure roller 31. Therefore, the sheet P can be prevented from adhering firmly to the fixing belt 21 after the fixing process.

Alternatively, the surface of the fixed member 26 facing the pressure roller 31 can be flat, not concave as in the present embodiment. In this case, because the nip portion can substantially parallel an image surface of the sheet P, allowing the sheet P to contact the fixing belt 21 more closely, a fixing property can be enhanced. Additionally, the curvature of the fixing belt 21 can be larger at the exit of the fixing nip portion, which facilitates separation of the sheet P from the fixing belt 21.

The surface layer 26*a* covering the surface of the fixed member 26 facing the pressure roller 31 is formed with fluorine-containing material. The base layer 26*b* is formed with a material such as rigid metal or ceramic that has a certain degree of rigidity so as not to be deformed significantly by the pressure from the pressure roller 31.

Herein, the pipe-shaped heating member 22 can be formed by curving a metal plate so that the heating member 22 can be relatively thin, reducing the warm-up time. However, when the heating member 22 is relatively thin, and accordingly its rigidity is relatively low, the heating member 22 can be deformed by the pressure from the pressure roller 31. In such a case, a desired nip width cannot be attained, and thus the fixing property is degraded.

In view of the foregoing, in the present embodiment, the relatively rigid fixed member 26 that is a separate member from the heating member 22 is used to form the nip portion.

Additionally, the thermal insulator 27 is provided between the fixed member 26 and the heater 25. More specifically, the thermal insulator 27 is provided between the fixed member 26 and the heating member 22 to cover a surface of the fixed member 26 except the surface (sliding surface) facing the pressure roller 31. The thermal insulator 27 can be formed with a material with a relatively high degree of thermal insulation such as spongy rubber, ceramic including blank pores, or the like.

In the present embodiment, because the heating member 22 is close to the fixing belt 21 across substantially its entire circumference, the fixing belt 21 can be heated relatively uniformly in the circumferential direction even during a waiting period for heating or waiting period for printing. Therefore, printing can be performed immediately upon receipt of a print request.

Herein, if the pressure roller 31 is heated while it is deformed at the nip portion in the waiting period for heating, thermal deterioration and/or permanent compressive distortion of the pressure roller 31 will occur depending on the characteristics of the rubber used therein. The degree of permanent compressive distortion of rubber is increased when deformed rubber is heated. If permanent compressive distortion of the pressure roller 31 occurs, that is, the pressure roller 31 is partly dented, the desired nip width may not be attained, typically causing fixing failure. Further, abnormal noise might be generated while the pressure roller 31 rotates.

In view of the foregoing, in the present embodiment, the thermal insulator 27 is provided between the fixed member 26 and the heating member 22 so as to prevent or reduce the heat transmitted from the heating member 22 to the fixed member 26 during the waiting period for heating, thereby preventing or reducing heating of the deformed pressure roller 31 during the waiting period for heating.

Additionally, if the lubricant provided between the fixed member 26 and the fixing belt 21 is exposed to a relatively high temperature in addition to a relatively high pressure applied to the nip portion, the lubricant will deteriorate, which can cause slip of the fixing belt 21, and the like.

Therefore, the thermal insulator 27 provided between the fixed member 26 and the heating member 22 can also prevent or reduce the heat transmitted from the heating member 22 to the lubricant.

Providing the thermal insulator 27 between the fixed member 26 and the heating member 22 can insulate the fixed member 26, thus restricting heating of the fixing belt 21 at the nip portion. Therefore, the temperature of the sheet P is lower when the sheet P leaves the fixing nip than when the sheet P enters the fixing nip. That is, because the temperature of the toner image T on the sheet P is decreased at the exit of the fixing nip, reducing viscosity of the toner on the sheet P, adhesion of the toner to the fixing belt 21 can be lower when the sheet P leaves the fixing belt 21. If adhesion force of the toner to the fixing belt 21 is higher after the fixing process, the sheet P might fail to leave the fixing belt 21, causing paper jam, and/or some toner might remain on the fixing belt 21, which can be prevented or reduced by proving the thermal insulator 27.

Moreover, as shown in FIG. 4, the holder 28 holds the concave portion 22*a* of the heating member 22 in which the fixed member 26 is inserted from the inner circumference side of the heating member 22.

A workable, stainless steel plate having a thickness of about 0.1 mm is bent to form the heating member 22 having a pipe shape. However, the stainless steel plate may not be bent to have certain shapes because springback of the stainless steel plate formed into the pipe causes a slit of the concave portion 22*a* to spread. If the concave portion 22*a* opens and spreads by the springback, the concave portion 22*a* will contact the inner surface of the fixing belt 21, and then the concave portion 22*a* will damage the fixing belt 21, and the fixing belt 21 may be heated unevenly because the heating member 22 and the fixing belt 21 contact unevenly. To address this, according to this embodiment, the holder 28 fixes the concave portion 22*a* of the heating member 22 so that the concave portion 22*a* does not open and spread by the springback of the heating member 22. Specifically, the holder 28 is press-fitted in the concave portion 22*a* of the heating member 22 from the inner circumference side of the heating member 22, holding the pipe shape of the heating member 22 bent so that the heating member 22 may resist spring-back of the heating member 22.

The heating member 22 may have a thickness not greater than about 0.2 mm to improve heating efficiency for heating the heating member 22.

The heating member 22 having a substantially pipe shape formed by bending a metal plate such as the stainless steel plate as described above may have a small thickness to shorten a warm-up time period of the fixing device 20. However, the thin heating member 22 may have a small rigidity. Accordingly, when the pressure roller 31 applies pressure to the heating member 22, the heating member 22 cannot resist the pressure applied by the pressure roller 31, and therefore the heating member 22 may be bent or deformed. The deformed heating member 22 may not provide the desired nip length of the nip portion N, thus deteriorating the fixing properties. To address this, according to this example embodiment, the pressure roller 31 does not mainly apply pressure to the thin heating member 22, and the pressure roller 31 mainly applies pressure to the fixed member 26 instead. As a result, the thin heating member 22 may not be deformed.

Description will be made below of operations of the above-described fixing device 20 with reference to FIGS. 1 and 2.

When the image forming apparatus 1 is powered on, activation of the heater 25 as well as rotation of the pressure roller 31 are started. Referring to FIG. 2, as the pressure roller 31 rotates in the direction indicated by arrow A2, the fixing belt 21 rotates in the direction indicated by arrow A1 due to frictional force therebetween.

Subsequently, the sheet feeder 12 feeds the sheet P to the secondary transfer roller 89, where the unfixed toner image T is transferred onto the sheet P. Then, being guided by a guide plate, not shown, the sheet P is transported in a direction indicated by arrow Y10 shown in FIG. 2 to the fixing nip formed between the fixing belt 21 and the pressure roller 31.

In the fixing nip, the toner image T is fixed on the sheet P with the heat from the fixing belt 21 that is heated by the heater 25 via the heating member 22 and the pressure from the pressure roller 31 as well as that from the fixed member 26 reinforced by the reinforcement member 23. Then, the sheet P is transported in a direction indicated by arrow Y11 shown in FIG. 2.

The configuration and the operations of the reflector 24 are described in further detail below as distinctive features of the present embodiment.

The reflector 24 is fixed to the reinforcement member 23. The reflector 24 reflects heater light (infrared rays) emitted by the heater 25 for the inner surface of the heating member 22. The reflector 24 is typically convex to match the curved surface shape of the inner surface of the heating member 22. In other words, as shown in FIG. 2, the reflector 24 facing the heater 25 has a form of a bow (convex shape) so that the central part of the reflector 24 approaches the heater 25.

Figure 5A:
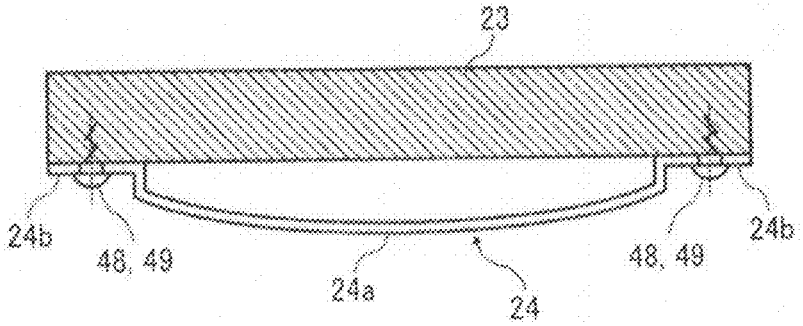
FIGS. 5A and 5B show the state where a reflector is attached to a reinforcement member.
Figure 5B:
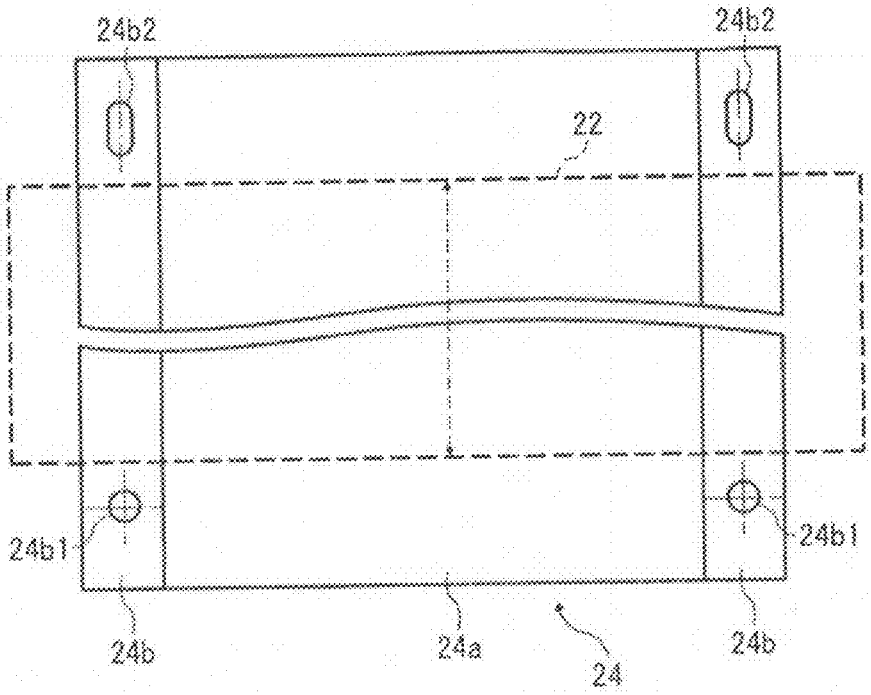

FIGS. 5A and 5B show the state where the reflector 24 is attached to the reinforcement member 23.

In detail, as shown in FIG. 5, the reflector 24 has a form of a beam and the reflector 24 has a curved surface part 24*a* and flat surface parts 24*b* formed in the both ends of the curved surface part 24*a*, respectively. In addition, the reflector 24 is an aluminum plate, and the thickness of the reflector 24 is 0.2 mm. Because the aluminum has high reflectance for the light (infrared rays) emitted from a heater, the aluminum is suitable as a material of the reflector 24.

As shown in FIG. 5, the flat surface parts 24*b* have a hole 24*b*1 to place a screw 48 through one end of the width direction of the reflector 24 and, in the another end, have a slot 24*b*2 for placement of a step portion of a step screw 49. The reinforcement member 23 has screw holes in both ends and the reflector 24 is detachably attached the reinforcement member 23 with the screws 48 and 49. In place of or in addition to the screws, the reflector 24 may be attached via other fasteners, such as bolts, for example.

In addition, the holes 24*b*1 and the slots 24*b*2 are located on the outside of the paper path area M, as shown in FIG. 3, and further, the holes 24*b*1 and the slots 24*b*2 are located on the outside of the range of the width direction of heating member 22 (range shown with a dashed line), as shown in FIG. 5B. In other words, as viewed in a direction perpendicular to the axis of rotation of the fixing belt 21, the holes 24*b*1 and the slots 24*b*2 are offset in the axial direction so as not to overlap with the fixing belt. One benefit of this arrangement is that it provides relatively easy access to the holes 24*b*1 and the slots 24*b*2 and any fasteners disposed therein. This access facilitates installation and removal of the reflector 24.

Thus, the reflector 24 can be removed from the reinforcement member 23 and the reflector 24 can be exchanged, even if lubricant which is volatilized adheres to the reflector 24, since the reflector 24 is detachably attached the reinforcement member 23. Since the holes 24*b*1 and the slots 24*b*2 of the reflector 24 are prepared out of the range of the width direction of the heating member 22, if the screws 48 and the step screws 49 are removed, the reflector 24 can be removed from fixing device 20. Therefore when removing the reflector 24, it is typically necessary to remove neither the fixing belt 21 nor the heating member 22 from fixing device 20. Thus, the efficiency of the exchange work of the reflector 24 can be raised.

Furthermore, since the slots 24*b*2 of the reflector 24 are long relative to a width direction even if the reflector 24 carries out thermal expansion with the heat of a heater 25, the step portions of the step screws 49 are relatively slid along the slot 24*b*2. This can prevent the warping of the reflector 24 in the width direction.

As explained above, the fixing device 20 of this embodiment has the reflector 24 of a convex shape (the curved surface part 24*a*) attached in the reinforcement member 23. With such a configuration, the heat or the heater light from the heater 25 toward the reinforcement member 23 spreads and reflects via the reflector 24 and then can be better used to heat the heating member 22, thus further enhancing the heating efficiency of the fixing belt 21 or the heating member 22.

Figure 6A:
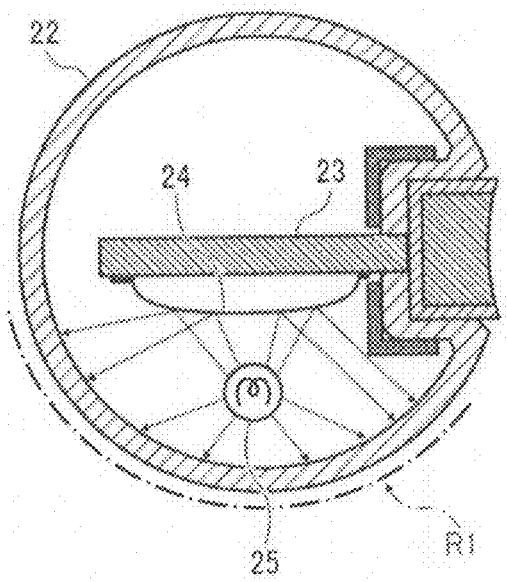
FIG. 6A shows the optical path of the heater light when the reflector of convex shape is installed in the reinforcement member.
Figure 6B:
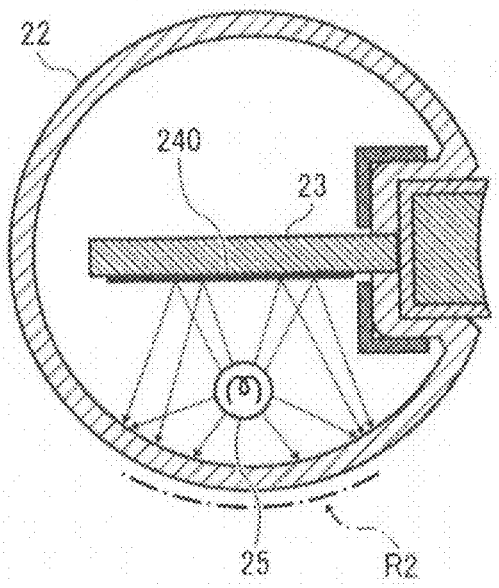
FIG. 6B shows the optical path of the heater light when the reflector of flat shape is installed in the reinforcement member.

FIG. 6A shows the optical path of the heater light when the reflector 24 of convex shape is attached the reinforcement member 23, FIG. 6B shows the optical path of the heater light when a reflector 240 of flat shape is attached the reinforcement member 23. The dash-dotted line of FIG. 6A shows a large irradiation range R1, the dash-dotted line of FIG. 6B shows a narrow irradiation range R2.

As shown in FIG. 6B, when the reflector 240 of flat shape is attached the reinforcement member 23, the heater light reflected by the reflector 240 irradiates intensively the narrow range R2 in inner circumference of the heating member 22. On the other hand, as shown in FIG. 6A, when the reflector 24 of convex shape is attached the reinforcement member 23, the heater light reflected by the reflector 24 is diffused and irradiates the large range R1 in inner circumference of the heating member 22.

Figure 7:
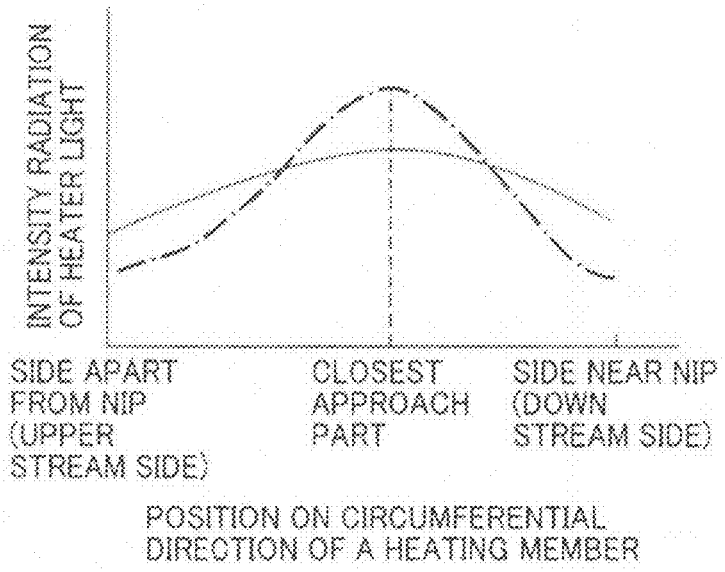
FIG. 7 is a graph which shows the relation between position based on a direction along a circumference of a heating member and intensity of heater light radiation.

FIG. 7 is the graph which shows the relation between position in the direction of the circumference of the heating member 22 and intensity of heater light radiation.

In FIG. 7, a curve shown as a solid line shows the result when using the reflector 24 of the convex shape shown in FIG. 6A. On the other hand, a curve shown with dash-dotted line shows the result when using the reflector 240 of the flat shape shown in FIG. 6B.

From these results, when the reflector 24 of convex shape is attached the reinforcement member 23, compared with the case where the reflector 240 of flat shape is attached the reinforcement member 23, it is shown that heater light is more readily irradiated uniformly in the large range of the inner circumference surface of the heating member 22. Thus, since the heating member 22 becomes more readily heated uniformly over the direction of the circumference of the heating member 22, the heating efficiency of the fixing belt 21 and the heating member 22 improve further.

The effect over the heating efficiency of the fixing belt 21 appears in the warm-up time (start up time) of the fixing device 20 notably.

Figure 8:
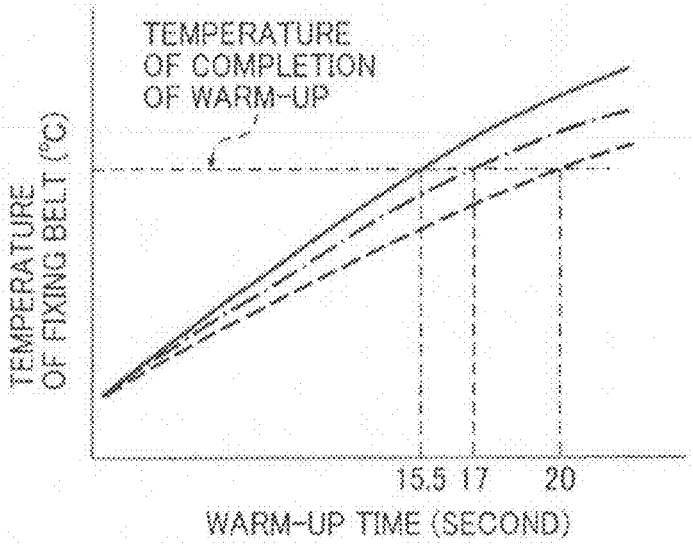
FIG. 8 is graph which shows warming up time about the case where the reflector of convex shape is used, the case where the reflector of flat shape is used, and the case where the reflector is not used.

FIG. 8 is the graph which shows the difference in the warm-up time of the case where the reflector 24 of the convex shape shown in FIG. 6A is used, the case where reflector 240 of the flat shape shown in FIG. 6B is used, and the case where a reflector is not used. In FIG. 8, a solid line shows the result at the time of using the reflector 24 of the convex shape, a dash-dotted line shows the result at the time of using the reflector 240 of flat shape, and a dashed line shows the result in the case of using neither reflector. In this example, the reflector 24 of convex shape is installed, warm-up time becomes 15.5 seconds, when the reflector 240 of flat shape is installed, warm-up time becomes 17 seconds, and in not installing a reflector, warm-up time becomes 20 seconds. These results show that the warm-up time at the time of installing the reflector 24 of convex shape becomes shorter compared with the warm-up time in the case of installing the reflector 240 of flat shape, and the warm-up time when no reflector is installed.

Moreover, although the reflector 24 of this embodiment is formed by a thin aluminum plate, since the reflector 24 is fixed to the solid reinforcement member 23, fault occurring when the reflector 24 transforms in response to external force from the reinforcement member 23 is less likely. Therefore, low cost, reduced weight, and the miniaturization of the reflector 24 are enabled because it is less necessary to secure the mechanical strength of reflector 24 in itself.

The reinforcement member 23 is arranged to almost divide the inside of the heating member 22 into two spaces along a line, and the heater 25 and the reflector 24 are arranged in the space on the upstream side for the fixing nip among two spaces divided by the reinforcement member 23. The meaning by the upstream of side for the fixing nip is an upper stream side on the basis of the fixing nip to the running direction of the fixing belt 21. In addition, the heater 25 is arranged substantially at the center in the space on the upstream side of the fixing nip.

As for the gap (clearance) δ between the inner circumferential surface 21*a* of the fixing belt 21 and the heating member 22, the upper stream side of the fixing nip becomes comparatively small compared with the lower stream side of the fixing nip. Because, in the upper stream side of the fixing nip, since the fixing belt 21 is pulled by rotation of the fixing belt 21 towards the fixing nip, the fixing belt tension by the side of the upper stream of the fixing nip becomes large compared with the lower stream side of the fixing nip. Therefore, since it becomes easy to transmit the heat of the heating member 22 to the fixing belt 21 efficiently, the heater 25 is arranged to the space by the side of the upper stream of the fixing nip.

The heater 25 is arranged substantially at the center in the space on the upstream side of the fixing nip. This improves the ability of the heater light reflected by the reflector 24 to diffuse uniformly widely in the direction of the circumference of inner surface of the heating member 22.

The curved surface form (the curved surface part 24*a*) of the reflector 24 is suitably defined by the simulation about an optical path of heater light so that heater light may diffuse uniformly widely in the direction of the circumference of inner surface of the heating member 22.

Moreover, as shown in FIG. 5A, the space between the reinforcement member 23 and the curved surface part 24*a* is an air layer, and functions as a heat insulation layer. Therefore, it becomes relatively easy for the reflector 24 to raise temperature compared with the case where the heat insulation layer is not installed. For this reason, the curved surface part 24*a* does not become dirty easily. For example, even if the lubricant applied to the inner circumference side of the fixing belt 21 volatilizes and the lubricant adheres to the reflector 24, the heat of the reflector 24 makes it difficult for the lubricant to solidify.

Figure 9:
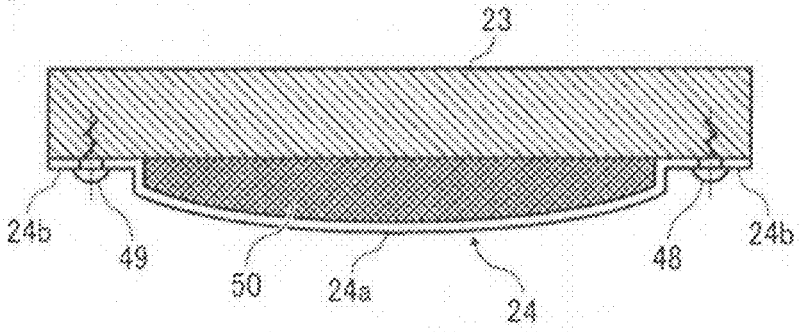
FIG. 9 shows a reflector according to another illustrative embodiment.

FIG. 9 is a reflector according to another illustrative embodiment.

Since the temperature of the reflector 24 will rise more easily if thermal insulation 50 is installed between the reinforcement member 23 and the curved surface part 24*a* as shown in FIG. 9, lubricant is less likely to adhere to the reflector 24. The materials of thermal insulation 50 are typically sponge rubber, ceramics which have air, etc.

Figure 10A:
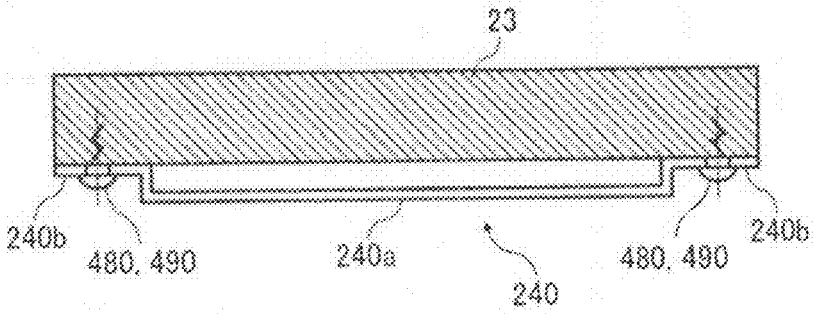
FIGS. 10A and 10B show the state where the reflector shown in FIG. 6B is attached to the reinforcement member.
Figure 10B:
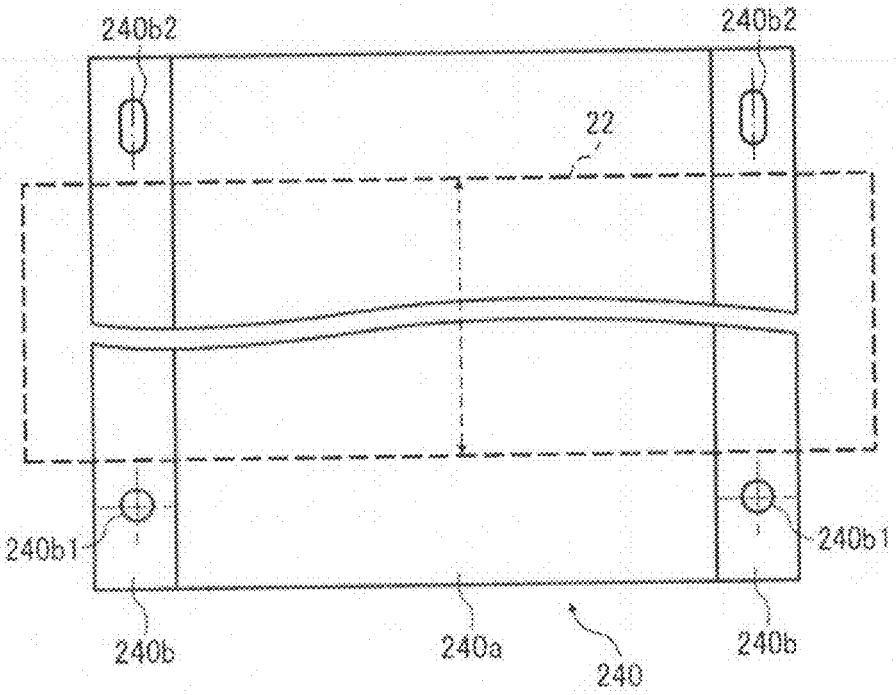

FIGS. 10A and 10B show the state where the reflector 240 shown in FIG. 6B is attached to the reinforcement member 23.

In detail, as shown in FIG. 10, the reflector 240 has a form of a beam and the reflector 240 has a first flat surface part 240*a* and second flat surface parts 240*b* formed in both ends of the first flat surface part 240*a*, respectively. In addition, the reflector 240 is an aluminum plate, and the thickness of the reflector 240 is 0.2 mm. Because the aluminum has high reflectance for the light (infrared rays) emitted from a heater, the aluminum is suitable as a material of the reflector 240.

As shown in FIG. 10, the second flat surface parts 240*b* have a hole 240*b*1 for placement of a screw 480 through one end of the width direction of the reflector 240 and, in the another end, have a slot 240*b*2 for placement of a step portion of a step screw 490. The reinforcement member 23 has screw holes in the both ends, and the reflector 240 is detachably attached to the reinforcement member 23 with the screws 480 and 490.

In addition, the holes 240*b*1 and the slots 240*b*2 are located on the outside of the paper path area M, as shown in FIG. 3, and further, the holes 240*b*1 and the slots 240*b*2 are located on the outside of the range of the width direction of heating member 22 (range shown with a dashed line), as shown in FIG. 10B.

Thus, the reflector 240 can be removed from the reinforcement member 23 and the reflector 240 can be exchanged, even if the lubricant that has volatilized adheres to the reflector 240, since the reflector 240 is detachably attached to the reinforcement member 23. Since the holes 240*b*1 and the slots 240*b*2 of the reflector 240 are typically prepared out of the range of the width direction of the heating member 22, if the screws 480 and the step screws 490 are removed, the reflector 240 can be removed from fixing device 20. Therefore when removing the reflector 240, it is necessary to remove neither the fixing belt 21 nor the heating member 22 from fixing device 20. Thus, the efficiency of the exchange work of the reflector 240 can be raised.

Furthermore, since the slots 240*b*2 of the reflector 240 are long relative to a width direction, even if the reflector 240 carries out thermal expansion with the heat of a heater 25, the step portions of the step screws 490 may slide along the slot 240*b*2. This can prevent the warping of the reflector 240 in the width direction.

As explained above, the fixing device 20 of this embodiment has the reflector 240 attached in the reinforcement member 23. With such a configuration, the heat or the heater light from the heater 25 toward the reinforcement member 23 reflects via the reflector 240 and then can be used to heat the heating member 22, thus further enhancing the heating efficiency of the fixing belt 21 or the heating member 22.

Alternatively, as the belt, an endless fixing film formed with polyimide, polyamide, fluorine-containing resin, or metal can be used.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device to fix a toner image on a sheet of recording media, comprising:

a first rotary member that rotates in a predetermined direction;

a second rotary member that contacts an outer circumferential surface of the first rotary member;

a pressing member disposed inside the first rotary member and that presses the first rotary member against the second rotary member to form a nip portion between the first and second rotary members through which the sheet is transported;

a reinforcement member provided at a location inside the first rotary member to support the pressing member;

a heat source to heat the first rotary member; and a reflector disposed relative to the reinforcement member to reflect heater light emitted from the heat source toward the first rotary member, the reflector is at a position that does not contact the first rotary member, wherein a space between the reinforcement member and the reflector is an air layer, wherein the reflector includes a surface that faces the heat source, a portion of the surface being curved, and wherein the reflector comprises an aluminum plate.

2. The fixing device of claim 1, wherein:

the pressing member comes in contact with an inner surface of the first rotary member.

3. The fixing device of claim 1, wherein:

the reflector is detachably attached to the reinforcement member.

4. The fixing device of claim 1, wherein:

the reflector does not contact the pressing member.

5. The fixing device of claim 1, further comprising:

thermal insulation disposed between the reflector and the reinforcement member.

6. The fixing device of claim 1, wherein an entirety of the curved portion of the surface of the reflector that faces the heat source is curved in a bow shape.

7. The fixing device of claim 1, wherein the surface of the reflector that faces the heat source is shaped as a bow.

8. The fixing device according to claim 1, wherein a direction of the curved portion of the surface of the reflector extends such that the curved portion is convex with respect to the heat source.

9. The fixing device according to claim 1, wherein:

the reflector comprises a curved part and a flat part.

10. An image forming apparatus comprising:

an image carrier which receives an electrostatic latent image;

a developing unit to develop the latent image received by the image carrier into a toner image;

a transfer unit to transfer the toner image onto a recording medium sheet; and a fixing device to fix the toner image on the sheet, the fixing device including a first rotary member that rotates in a predetermined direction, a second rotary member that contacts an outer circumferential surface of the first rotary member, a pressing member disposed inside the first rotary member and that presses the first rotary member against the second rotary member to form a nip portion between the first and second rotary members through which the sheet is transported;

a reinforcement member provided at a location inside the first rotary member to support the pressing member, a heat source to heat the first rotary member, and a reflector disposed relative to the reinforcement member to reflect heater light emitted from the heat source toward the first rotary member, the reflector is at a position that does not contact the first rotary member, wherein a space between the reinforcement member and the reflector is an air layer, wherein the reflector includes a surface that faces the heat source, a portion of the surface being curved, and wherein the reflector comprises an aluminum plate.

11. The image forming apparatus according to claim 10, wherein:

the reflector comprises a curved part and a flat part.

12. An image forming apparatus, according to claim 11, wherein:

the first rotary member includes two ends, with a flange disposed at each of the two ends.

13. An image forming apparatus, according to claim 10, wherein:

the surface of the reflector that faces the heat source includes a bow shape.

14. A fixing device to fix a toner image on a sheet of recording media, comprising:

a first rotary member that rotates in a predetermined direction;

a second rotary member that contacts an outer circumferential surface of the first rotary member;

a pressing member disposed inside the first rotary member and that presses the first rotary member against the second rotary member to form a nip portion between the first and second rotary members through which the sheet is transported;

a reinforcement member provided at a location inside the first rotary member to support the pressing member;

a heat source to heat the first rotary member; and a reflector disposed relative to the reinforcement member to reflect heater light emitted from the heat source toward the first rotary member, the reflector is at a position that does not contact the first rotary member, wherein a space between the reinforcement member and the reflector is an air layer, and wherein the reflector includes a convex surface that faces the heat source.

15. The fixing device according to claim 14, wherein the convex surface of the reflector that faces the heat source includes a flat portion and a curved portion.

16. The fixing device according to claim 14, wherein:

the reflector comprises a curved part and a flat part.

17. The fixing device according to claim 14, wherein:

the reflector comprises a curved aluminum plate.

18. An image forming apparatus, comprising the fixing device of claim 14.

* * * * *